United States Patent [19]

Matsumoto et al.

[11] 4,375,327

[45] Mar. 1, 1983

[54] ROLLER FIXING DEVICE

[75] Inventors: Kenichi Matsumoto, Tokyo; Hiroaki Ura, Kunitachi; Tamio Ogino; Junichi Koiso, both of Hachioji, all of Japan

[73] Assignee: Konishiroku Photo Industry Co., Inc., Tokyo, Japan

[21] Appl. No.: 328,919

[22] Filed: Dec. 9, 1981

[30] Foreign Application Priority Data

Dec. 22, 1980 [JP] Japan ..... 55-182277

[51] Int. Cl.[3] ..... G03G 15/00

[52] U.S. Cl. ..... 355/3 FU; 355/3 SH; 271/311; 271/DIG. 2

[58] Field of Search ..... 355/3 FU, 3 SH; 219/216, 388; 271/DIG. 2, 311, 312

[56] References Cited

U.S. PATENT DOCUMENTS

| | | | |
|---|---|---|---|
| 3,881,859 | 5/1975 | Hamilton | 271/DIG. 2 |
| 3,918,804 | 11/1975 | Bar-on | 355/3 FU |
| 3,955,916 | 5/1976 | Bar-on | 271/DIG. 2 |
| 3,957,423 | 5/1976 | Mueller | 271/DIG. 2 |
| 3,998,584 | 12/1976 | Wada et al. | 219/216 |
| 4,065,120 | 12/1977 | Imaizumi et al. | 271/311 |
| 4,080,159 | 3/1978 | Behun | 355/3 FU |
| 4,145,599 | 3/1979 | Sakurai et al. | 219/216 |
| 4,156,524 | 5/1979 | Bar-on | 271/DIG. 2 |
| 4,332,457 | 6/1982 | Mitsuyama et al. | 355/3 FU |
| 4,336,992 | 6/1982 | Szulha et al. | 271/DIG. 2 |

*Primary Examiner*—R. L. Moses

*Attorney, Agent, or Firm*—James E. Nilles

[57] ABSTRACT

A roller fixing device wherein a claw member facing a pressure roller is arranged so that the distance between the contact point of a roller and a pressure roller and the top end portion of said claw member be within 6.5 mm on the pressure roller periphery and an angle between a tangential line of the pressure roller at a point where said top end portion of said claw member contacts under pressure with said pressure roller and the upper edge of said claw member be at least 45 degrees. Said roller is a heat roller including a heater therein. An electrophotographic copying machine which comprises: a charge receptor, a latent image forming means for forming an electrostatic latent image on said charge receptor, a developing means for developing said electrostatic latent image, a transferring means for transferring said developed image to a transfer material, and said roller fixing device.

12 Claims, 2 Drawing Figures

ROLLER FIXING DEVICE

BACKGROUND OF THE INVENTION

1. Field of the Invention

This invention relates to a roller fixing device, and more particularly a heat roller fixing device having an improved claw member.

2. Description of the Prior Art

Generally, in an image formation process using a recording device, for instance, an electrophotographic copying machine, a visible image is formed by forming an electrostatic latent image corresponding to a document image with a corona charge and a light irradiation on a charge receptor using an insulating photoconductive material or the like as a photosensitive member, and developing it with a toner developer containing colored fine thermoplastic powders as a main ingredient. The visible image or toner image thus formed on a charge receptor is transferred to a transfer material such as a paper.

The toner image transferred on the transfer material as described above, is fixed on the transfer material with the conventional heating means and the image formation process is completed.

As a heat means in the heat fixing device as described above, a heat roller fixing device is widely used from the reasons that there exists no danger of firing since said device is comparatively simple in mechanism, high in heat transfer efficiency and is possible to lower the set temperature.

The heat roller fixing device having such advantages generally consists of a heat roller having a heater therein and a pressure roller in contact with said heat roller under pressure, and the surface of said heat roller in contact with the toner is coated with a heat resistant resin such as Teflon (Trade Mark) or the like in order to improve releasability from the toner and impart heat resistance thereto, while the pressure roller which contacts with this under pressure must have a certain nip width with said heat roller as well as releasability and heat resistance. Accordingly, the pressure roller is required to be resilient and, for instance, the lining with a silicone rubber is generally performed.

However, even when the heat roller having an improved releasability is used, the transfer material may wrap around the roller, because small amounts of toner adhere and pile on the surface of the roller by fixing a copy on which the toner is given extensively or by repeating the fixing for a long period and eventually both rollers are stained.

As a means to prevent the wrapping phenomenon, providing a plurality of separation claws adjacent to the roller is believed to be an effective method.

On the other hand, in accordance with the recent tendency toward a high-speed copying machine, attempts have been made at shortening of copying time per one sheet by carrying transfer material in the direction along its shorter side to increase the amount of the transfer material to be processed within a given time.

Consequently, the roller fixing device of the copying machine has had to be lengthened in accordance with a longer side of the transfer material, and a new problem on its mechanism such as bending of the roller has occurred. Furthermore, when, for example, thin transfer material is used, curling of the paper, particularly wave curling also becomes remarkable.

FIG. 1 is an exterior view which shows a constitution of the conventional heat roller fixing device.

In FIG. 1, numeral 1 is a driven heat roller, and a coating layer 2 made of Teflon or the like is provided on the surface thereof. Numeral 3 is a heater housed within the roller 1. Numeral 4 is a pressure roller which can contact with said heat roller 1 under pressure and move therewith, and on the surface of said pressure roller is provided a lining layer 5 consisting of silicone rubber 5 mm thick. Said heat roller 1 and pressure roller 4 contact under pressure with each other only during fixing operation by a pressure operating device (not shown), or affords a nip width N while being always contacted under pressure. Numeral 6 is an upper separation claw which is provided so that the top end portion thereof may contact under pressure with the surface of the heat roller 1 to prevent the transfer material 8 from wrapping around the heat roller 1. Numeral 7 is a lower separation claw which is provided so that the top end portion thereof may contact with the pressure roller 4 with the same object as that of the upper separation claw 6. The material for said separation claws 6 and 7 is preferably heat-resistant resin, and the surface of the top end portion thereof may be coated with a fluorine-containing resin in order to prevent the toner from adhering thereon.

The separation claws 6 and 7 are pivotably supported by guide plates 9 and 10, respectively. The angle formed between the top end portion thereof and the roller is designed so that the top end portion of said claw may not damage the surface of the roller and may separate effectively considering the nature of material for counterpart rollers 1 and 4.

When thin transfer material 8 is used in the heat roller fixing device constituted as described above, wave curling occurs, after it has passed through the nip width of the roller, in a region with a length L between the endpoint of said nip width and the point where the top end portion of the lower side separation claw 7 is brought into contact with the surface of the pressure roller 4.

One cause of the occurrence of the wave curling is overheating by the fixing device. In other words, in recent copying machines, the basis weight of the transfer material used is progressively increasing and accordingly the machine is designed to be capable of handling thick transfer material such as one with 110 kg basis weight. As a result, more heat energy than heretofore is given to the fixing device to accomplish a sufficient fixing even when the thick paper as described above is used.

Therefore, when thin transfer material of, for instance, 45 kg basis weight is used, excessive heat is inevitably given in fixing, resulting in the lowering of stiffness of the transfer material and occurrence of the curling.

When such transfer material passes through the nip width of the roller as described above, wave curling occurs by the fluctuation of the transfer material between the endpoint of said nip width and the point where the top end portion of the lower separation claw is brought into contact with the pressure roller surface (L in FIG. 1).

In the conventional fixing device, said distance L is approximately 10 mm.

SUMMARY OF THE INVENTION

An object of this invention is to improve the drawbacks described above, and particularly to provide a roller fixing device which does not cause the occurrence of wave curling even when using thin transfer material.

We, inventors of this invention examined the above problems from various viewpoints. As a result, we confirmed that in a roller fixing device consisting of a roller, a pressure roller which contacts under pressure with said roller, and claw members positioned at the rear of said pair of rollers and each arranged so as to contact under pressure with the surface of each of said pair of rollers, respectively, the above object can be attained by using a roller fixing device in which the claw member facing said pressure roller is arranged so that the distance between the contact point of said rollers of said pair and the top end portion of said claw member be within 6.5 mm on the roller periphery and an angle between a tangential line of the roller at a point where the top end portion of said claw member contacts under pressure with said roller and the upper edge of said claw member be at least 45 degrees.

Other objects and features of this invention will be made clear by the following explanation of the drawings.

DESCRIPTION OF THE PREFERRED EMBODIMENTS

Figure 1:
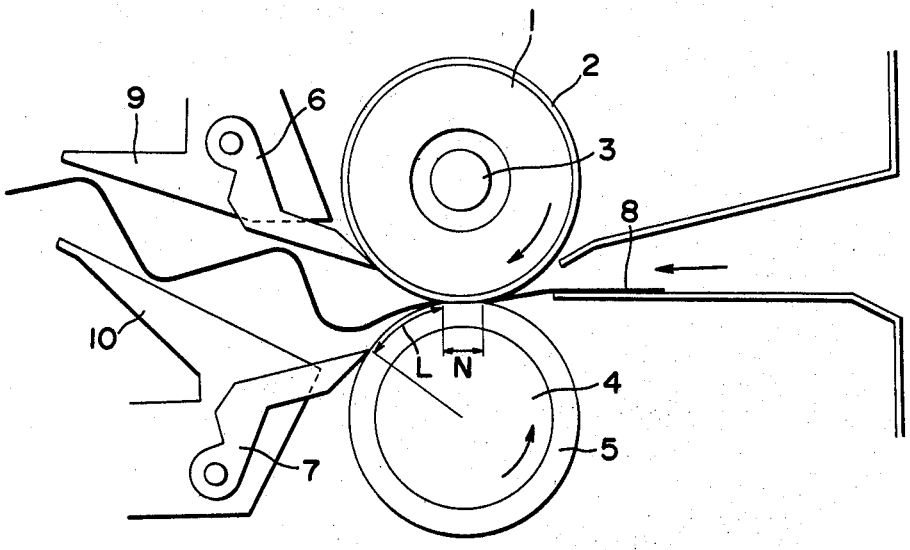
PRIOR ART FIG. 1
FIG. 1 is an exterior view which shows a constitution of the conventional heat roller fixing device.
Figure 2:
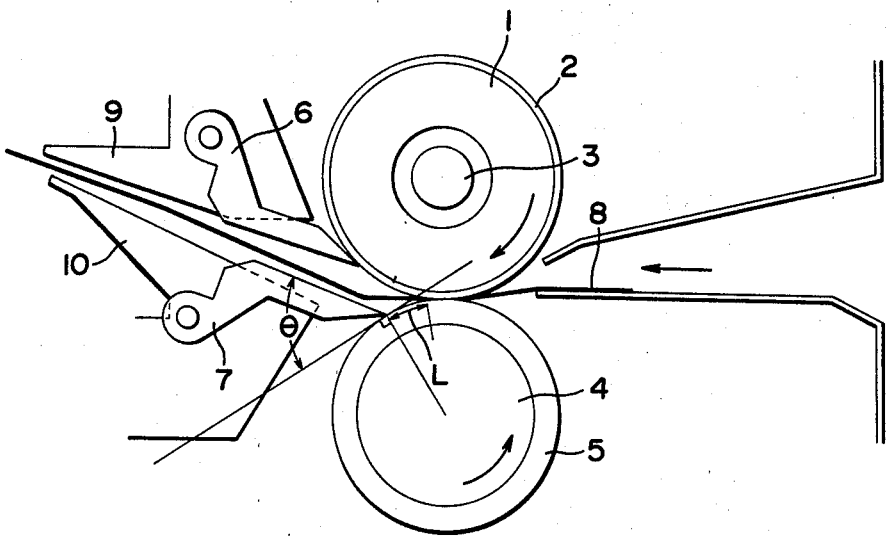
FIG. 2 is an exterior view which shows a constitution of the heat roller fixing device according to the present invention.

As shown in FIG. 2, in a heat roller fixing device of this invention, the above-mentioned distance L is preferably as short as possible. It was found that when the thickness of the lower separation claw 7, the diameter of the pressure roller 4 and the like are taken into consideration, the distance L between the endpoint of said nip width and the point where the top end portion of said separation claw 7 is brought into contact with the surface of the roller has limitation per se and it is very difficult to reduce the distance below 5 mm. In effect, it was found that the distance within 6.5 mm will suffice.

As the same time, a guide angle $\theta$ between the upper edge which forms the top end portion of the lower separation claw 7 set in accordance with the conditions described above and the tangential line of the roller at the top end portion thereof is preferably at least 45 degrees. Still preferably, by arranging the upper edge of guide plate 10 which pivotably supports said separation claw 7 in parallel with the upper edge of said separation claw 7 and bending the path of the transfer material after fixing, the fluctuation of said transfer material can be completely prevented.

Accordingly, the occurrence of wave curling caused by the fluctuation of the transfer material can be avoided in advance.

In this invention, as described above in detail, wave curling of thin transfer material during fixing is prevented from occurring by selecting and regulating the position where the separation claw facing the pressure roller contacts with the roller and the guide angle between said claw and the tangential line of the roller properly. However, other members may be used in place of the separation claw and the constitution having the same effect may be established, if necessary, on the heat roller instead of on the pressure roller.

What is claimed is:

1. In a roller fixing device comprising a roller, a pressure roller which contacts under pressure therewith, and claw members positioned at the rear of said pair of rollers and each arranged so as to contact under pressure with the surface of each of said pair of rollers, respectively, the improvement wherein said claw member facing said pressure roller is arranged so that the distance between the contact point of said rollers of said pair and the top end portion of said claw member be within 6.5 mm on the pressure roller periphery and an angle between a tangential line of the pressure roller at a point where said top end portion of said claw member contacts under pressure with said pressure roller and the upper edge of said claw member be at least 45 degrees.

2. A roller fixing device according to claim 1, wherein said roller is a heat roller.

3. A roller fixing device according to claim 2, wherein said heat roller is housed a heater within the heat roller.

4. A roller fixing device according to claim 1, wherein said distance is not more than 5 mm.

5. A roller fixing device according to claim 1, wherein said device further comprises a guide plate which pivotably supports said claw member facing said pressure roller.

6. A roller fixing device according to claim 5, wherein an upper edge of said guide plate is parallel with an upper edge of said claw member.

7. A roller fixing device according to claim 5, wherein said device further comprises a guide plate which pivotably supports said claw member facing said roller.

8. A roller fixing device according to claim 7, wherein an upper edge of said guide plate is parallel with an upper edge of the claw member facing said roller.

9. A roller fixing device according to claim 5, wherein the distance is not more than 5 mm.

10. A roller fixing device according to claim 5, wherein the roller is a heat roller.

11. A roller fixing device according to claim 10, wherein said heat roller is haused a heater within the heat roller.

12. An electrophotographic copying machine which comprises: a charge receptor, a latent image forming means for forming an electrostatic latent image on said charge receptor, a developing means for developing said electrostatic latent image, a transferring means for transferring said developed image to a transfer material, and a roller fixing device comprising a roller, a pressure roller which contacts under pressure therewith, and claw members positioned at the rear of said pair of rollers and each arranged so as to contact under pressure with the surface of each of said pair of rollers, respectively, and said claw member facing said pressure roller is arranged so that the distance between the contact point of said rollers of said pair and the top end position of said claw member be within 6.5 mm on the pressure roller periphery and an angle between a tangential line of the pressure roller at a point where said top end portion of said claw member contacts under pressure with said pressure roller and the upper edge of said claw member be at least 45 degrees.

* * * * *